US005513787A

United States Patent [19]

Reed

[11] Patent Number: 5,513,787

[45] Date of Patent: May 7, 1996

[54] SHOE TRANSPORT BAG ARRANGEMENT

[76] Inventor: Delores T. Reed, 1872 S. Millard Ave., Chicago, Ill. 60623

[21] Appl. No.: 380,708

[22] Filed: Jan. 30, 1995

[51] Int. Cl.[6] ..... A45C 3/12

[52] U.S. Cl. ..... 224/205; 224/202; 36/7.1 R; 36/7.3

[58] Field of Search ..... 224/202, 205, 224/207, 257, 917, 919; 294/146; 190/125, 127; 36/1, 50.1, 7.1, 7.3

[56] References Cited

U.S. PATENT DOCUMENTS

| | | | |
|---|---|---|---|
| 2,672,263 | 3/1954 | Alber | 224/205 |
| 4,126,256 | 11/1978 | McGruder | 224/205 |
| 4,376,444 | 3/1983 | Kimsey | 36/7.1 |
| 4,514,915 | 5/1985 | Galletta | 36/7.1 |
| 4,538,368 | 9/1985 | Mugford | 36/7.1 |
| 4,713,895 | 12/1987 | Vallieres | 36/7.1 |
| 4,790,462 | 12/1988 | Kawaguchi | 224/202 |
| 4,896,438 | 1/1990 | DeBease | 36/7.3 |
| 5,129,560 | 7/1992 | Herman | 224/205 |

*Primary Examiner*—Henry J. Recla
*Assistant Examiner*—Charles R. Eloshway

[57] ABSTRACT

A shoe transport bar arrangement permitting ease of transport of athletic shoes and the like, wherein spaced bag members are arranged for complementary reception of a shoe member within each respective bag member, with a connecting strap having zippered compartments to accommodate various personal items therewithin, and each of the bag members having a first cavity to receive a shoe member, with the second cavity defined by an apertured floor hingedly secured to the floor of the bag member to permit transport of various athletic components requiring ventilation through an apertured floor surface.

4 Claims, 4 Drawing Sheets

SHOE TRANSPORT BAG ARRANGEMENT

TECHNICAL FIELD

The field of invention relates to accessory bag structure, and more particularly pertains to a shoe transport bag arrangement wherein a plurality of spaced bags are secured together by an interconnecting web to permit ease of transport of shoes such as athletic shoes and the like by an individual.

BACKGROUND OF THE INVENTION

Various carrying structure has been presented in the prior art such as U.S. Pat. No. 5,285,939 wherein a bag member is arranged to receive a plurality of boots, such as ski boots and the like, utilizing strap connecting structure.

U.S. Pat. Nos. 4,669,772 and 4,113,159 are further examples of shoe carrier structure typically carrying shoes as in U.S. Pat. No. 5,285,939 in an exposed manner. U.S. Pat. No. 5,267,6680 sets forth a carrying sling for a car seat such as for an infant, with U.S. Pat. No. 4,476,859 having a shoulder sling structure relative to the strap structure extending therefrom.

SUMMARY OF THE INVENTION

The shoe transport bag arrangement of the invention employs a flexible connecting web having pockets for transport of various personal components such as jewelry, writing instruments, and the like, with the connecting strap separably secured to a plurality of shoe transport bags at each end of the connecting straps, such that each of the transport bags includes a first cavity for complementarily receiving a shoe therewithin, and a second cavity for securing an odor preventing member, wherein the first cavity and the second cavity are separated by an impermeable floor, and a second floor of the second cavity is hingedly mounted to the associated bag member by a connecting web portion.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
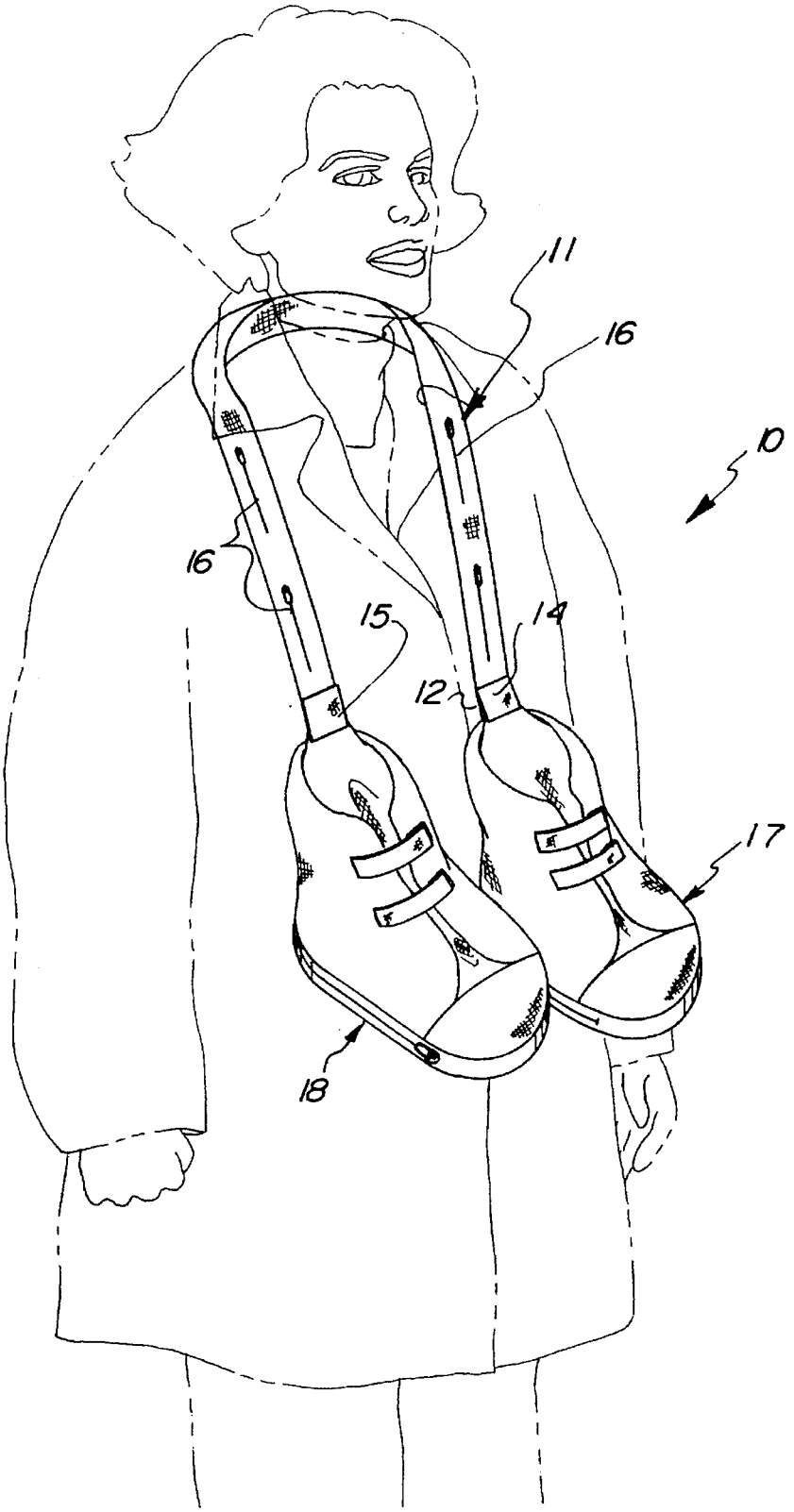
FIG. 1 is a perspective illustration of the invention as positioned about an individual.
Figure 2:
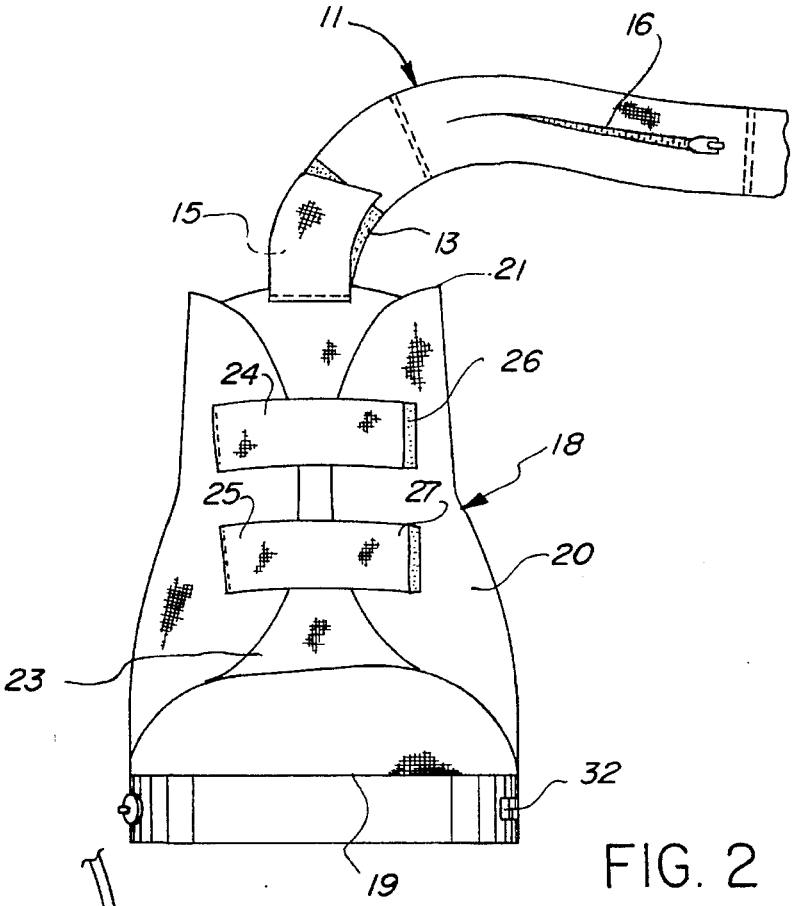
FIG. 2 is a front view, taken in elevation, of a bag member of the plurality of bag members.

The shoe transport bag arrangement 10 of the invention essentially comprises an elongate, flexible connecting strap 11, having a strap first end hook and loop fastener web 12 at a first end of the strap, with a strap second end hook and loop fastener web 13 at the second end of the strap, with the first and second end webs 12 and 13 respectfully arranged for selective securement to first and second bag hook and loop fastener webs 14 and 15 of the respective first and second bag members 17 and 18, such as depicted in FIG. 1. For purpose of illustration, however, only one of the bag members 17 and 18 are described inasmuch as the first and second bag members are of substantially identical construction.

Figure 6:
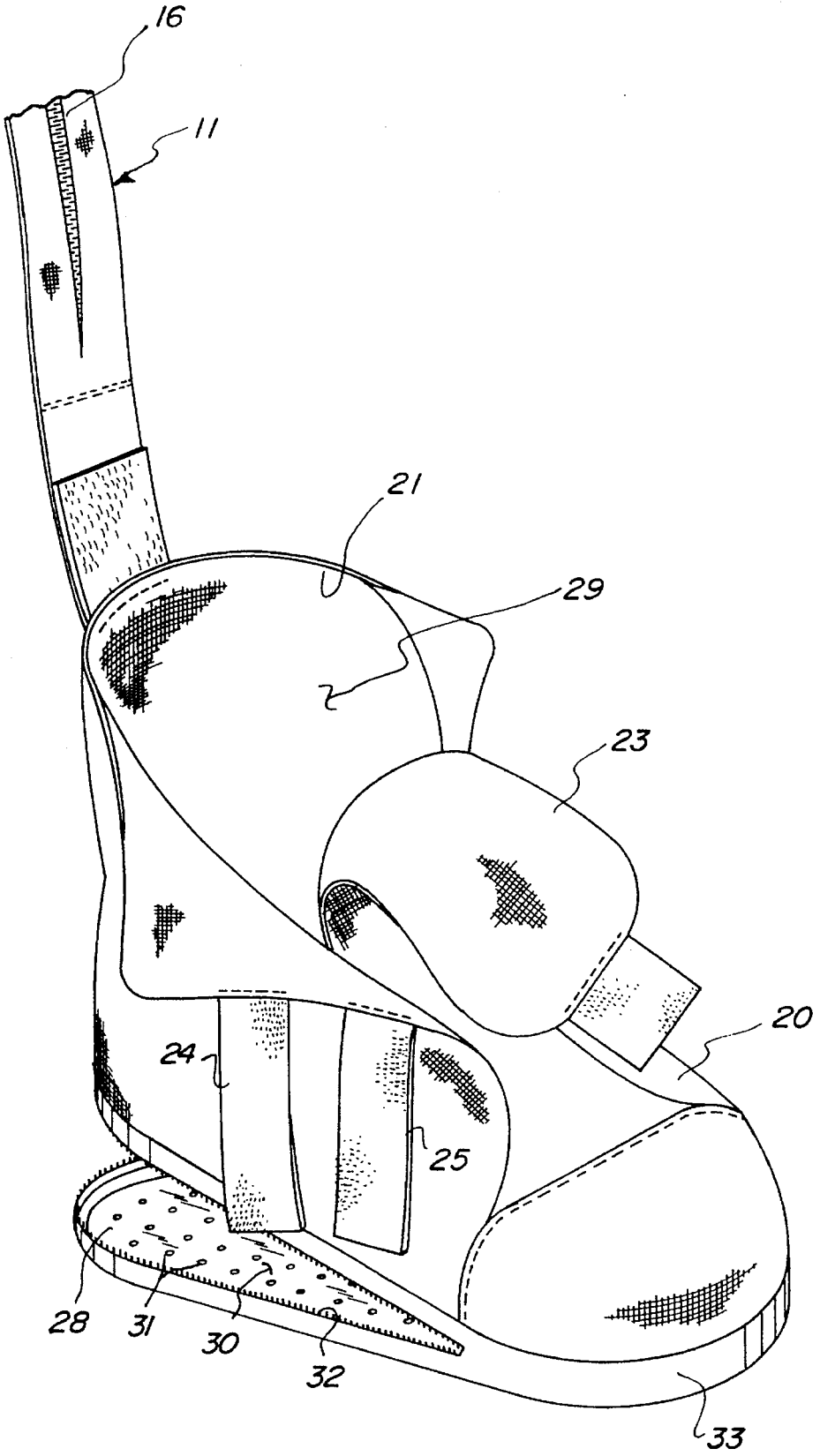
FIG. 6 is a perspective enlarged illustration of the bag member arranged to indicate the first and second cavities exposed for access.

The connecting strap 11 is formed with a plurality of zippered pockets 16 throughout the connecting strap to accommodate various personal items such as jewelry, writing instruments, and the like. The bag member, such as illustrated in the FIGS. 2–6, are representative of the first and second bag members 17 and 18 and includes a floor 19 from which a shoe upper 20 extends. An entrance opening 21 is oriented at an uppermost terminal end of the shoe upper 20 to accommodate a shoe, such as an athletic shoe and the like for transport within a first cavity 29 oriented within the shoe upper 20 and the floor 19 accessed through the entrance opening 21. The shoe upper 20 defines an upper web split 22 extending from a forwardmost end of the shoe to the entrance opening 21, with a tongue web 23 integral with the shoe upper extending coextensively of the shoe web's split, with the tongue web 23 positioned within the first cavity 29. First and second connecting straps 24 and 25 are arranged for selective fastening to respective third and fourth connecting straps 26 and 27, with the first and second connecting straps 24 and 25 positioned on a first side of the web's split 22, with the third and fourth connecting straps 26 and 27 positioned on an opposed side of the web's split. Upon disengagement of the first and second connecting straps 24 and 25 to the respective third and fourth connecting straps 26 and 27, the tongue web 23 may be displaced exteriorly of the first cavity 29, such as illustrated in FIG. 6, permitting a shoe member (not shown) to be positioned within the first cavity accessed through the entrance opening 21.

Figure 3:
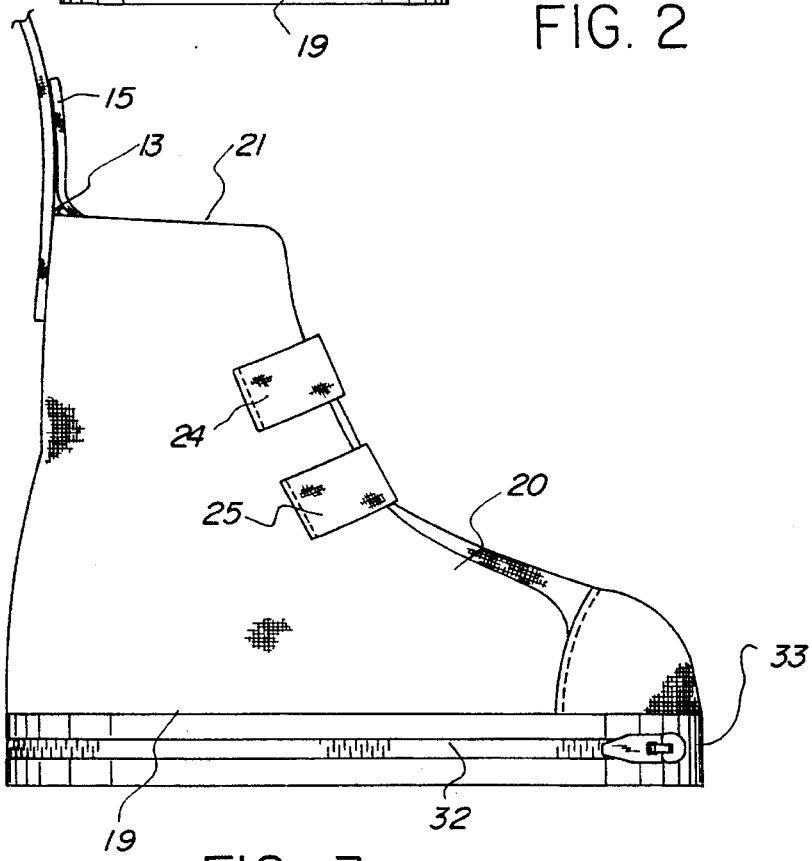
FIG. 3 is a side view, taken in elevation, of the bag members such as illustrated in FIG. 2.
Figure 4:
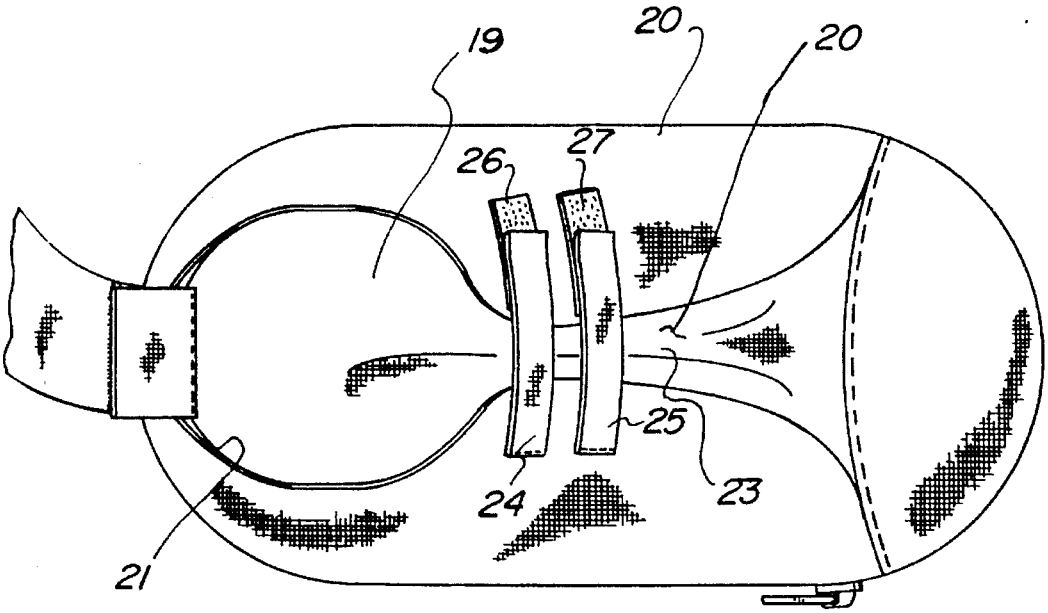
FIG. 4 is a top plan view of the bag member, such as illustrated in the FIGS. 2 and 30
Figure 5:
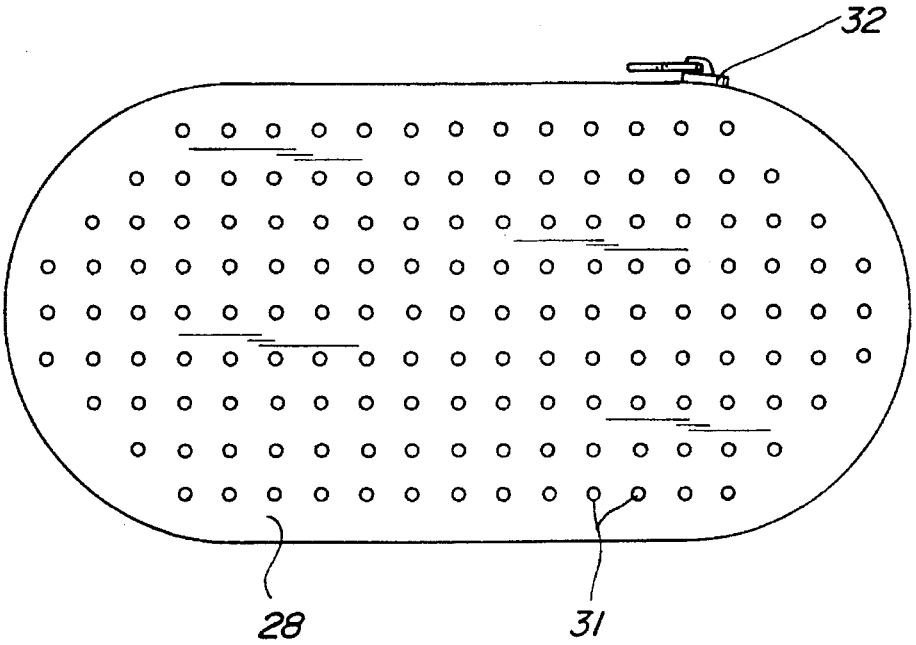
FIG. 5 is a bottom plan view of the bag member, such as illustrated in FIG. 4.

A second floor 28 is hingedly mounted about a toe or forward end portion of the bag member about a hinge web portion 33, such as indicated in the FIGS. 3 and 6 for example, such that the hinge web portion 33 has extending therefrom a second floor 28 that includes a matrix of second floor apertures 31.

A second cavity connector 32 configured as an elongate, discontinuous zipper selectively secures the second floor 28 to a spaced relationship relative to the floor 19 to define a second cavity 30 that may receive various components to be aired, such as aired through ventilation by the apertures 31 to receive such components as odor reducing sole members to be inserted within an associated shoe member or various other components such as gymnasium sox and the like.

In this manner, a pair of athletic shoes and the like may be transported by the first and second bag members 17 and 18 in a convenient manner. Alternatively, the strap 11 may be fixedly secured at its first and second ends to the first and second bag members in lieu of the central connection structure as described and illustrated. Further, the connecting strap 11 as well as the first and second bag members are typically formed of a water repellent material to include polymerics, fabrics, and the like.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A shoe transport bag arrangement, comprising, a flexible, elongate connecting strap, having a strap first end spaced from a strap second end, with a first bag member arranged for securement to the first end and a second bag member arranged for securement to the second end, and the first bag member and the second bag member are each configured of a shoe-like configuration, and each of said first bag member and said second bag member having a floor, with a shoe upper extending from the floor terminating in an entrance opening, and a shoe upper web split extending from a forward end of the shoe upper to the entrance opening, with a tongue web hingedly secured to the shoe upper at the forward end extending coextensively of the web split to the entrance opening, and a first cavity defined within the shoe upper extending from the floor, and the tongue web positioned within the first cavity, each of said first bag member and second bag member having a first connecting strap secured to a first side of the web split to extend over the web split, and a further connecting strap arranged for selective securement to the first connecting strap and to extend over the web split, whereupon separation of the first connecting strap relative to the further connecting strap permits displacement of the tongue web from the first cavity for access of a shoe member within the first cavity through the entrance opening; and, a second floor spaced from the floor, with the second floor positioned exteriorly of the first cavity, and the second floor hingedly secured to the floor about a hinge web portion at the forward end, with a discontinuous fastener extending between the floor and the second floor for selective securement of the second floor relative to the floor, with a second cavity defined between the floor and the second floor.

2. A bag arrangement as set forth in claim 1 wherein the second floor includes a matrix of apertures directed therethrough to permit ventilation into the second cavity when the second floor is secured relative to the floor by the discontinuous fastener.

3. A bag arrangement as set forth in claim 2 wherein the strap first end includes a first end hook and loop fastener web, and the strap second end includes a strap second end hook and loop fastener web, and the first bag member having a first bag hook and loop fastener web secured to the first bag at the entrance opening for selective securement of the first end hook and loop fastener web to the first bag hook and loop fastener web, and a second bag hook and loop fastener secured to the second bag at the entrance opening, with the strap second end hook and loop fastener web arranged for selective securement to the second bag hook and loop fastener web.

4. A bag arrangement as set forth in claim 3 with the strap member having at least one zippered pocket within the strap member for accommodating various articles therewithin.

* * * * *